US005368155A

United States Patent [19]

Ewen

[11] Patent Number: 5,368,155

[45] Date of Patent: Nov. 29, 1994

[54] CIGARETTE BUTT RECEIVING PACKAGE

[76] Inventor: Jerome F. Ewen, 3538 Oak Bend Dr., Arlington, Tex. 76016

[21] Appl. No.: 130,705

[22] Filed: Oct. 4, 1993

[51] Int. Cl.[5] ..... B65D 85/10

[52] U.S. Cl. ..... 206/86; 131/236; 206/246

[58] Field of Search ..... 206/85-87, 206/89, 246, 255, 256-258; 131/231, 235.1, 236, 238, 239

[56] References Cited

U.S. PATENT DOCUMENTS

| | | | |
|---|---|---|---|
| 1,490,232 | 4/1924 | Robinson | 131/239 |
| 1,693,096 | 11/1928 | Samuels | 206/246 |
| 1,717,320 | 6/1929 | Victor | 206/246 |
| 1,840,664 | 1/1932 | Gerstheimer | 206/246 |
| 2,811,247 | 10/1957 | Stevenson | 206/86 |
| 2,958,417 | 11/1960 | Adams | 206/246 |
| 3,096,878 | 7/1963 | Whitley et al. | 206/246 |
| 4,190,148 | 2/1980 | Schade, II et al. | 206/89 |
| 4,789,059 | 12/1988 | Kim | 206/246 |
| 4,852,729 | 8/1989 | Conte | 206/87 |

*Primary Examiner*—Jimmy G. Foster
*Attorney, Agent, or Firm*—E. Michael Combs

[57] ABSTRACT

A cigarette package is arranged to include a push plate having at least one spring member mounted between the push plate and a side wall of the package to define a receiving space for reception of cigarette butts therewithin.

4 Claims, 4 Drawing Sheets

CIGARETTE BUTT RECEIVING PACKAGE

BACKGROUND OF THE INVENTION

1. Field of the Invention

The field of invention relates to cigarette package construction, and more particularly pertains to a new and improved cigarette butt receiving package wherein the package structure is arranged to accommodate discarded cigarette butts.

2. Description of the Prior Art

The disposal of cigarette butts has become an ever-increasing concern due to the advent of limited public spaces available for smoking and the like. To this end, the instant invention attempts to overcome deficiencies of the prior art by providing for a package structure arranged to accommodate cigarette butts subsequent to the smoking of a cigarette and in this respect, the present invention substantially fulfills this need.

SUMMARY OF THE INVENTION

In view of the foregoing disadvantages inherent in the known types of cigarette package construction now present in the prior art, the present invention provides a cigarette butt receiving package wherein the same is arranged to accommodate cigarette butts in a compartmentalized manner relative to unused cigarette members. As such, the general purpose of the present invention, which will be described subsequently in greater detail, is to provide a new and improved cigarette butt receiving package which has all the advantages of the prior art cigarette package structure and none of the disadvantages.

To attain this, the present invention provides a cigarette package arranged to include a push plate having at least one spring member mounted between the push plate and a side wall of the package to define a receiving space for reception of cigarette butts therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cigarette butt receiving package which has all the advantages of the prior art cigarette package structure and none of the disadvantages.

It is another object of the present invention to provide a new and improved cigarette butt receiving package which may be easily and efficiently manufactured and marketed.

It is a further object of the present invention to provide a new and improved cigarette butt receiving package which is of a durable and reliable construction.

An even further object of the present invention is to provide a new and improved cigarette butt receiving package which is susceptible of a low cost of manufacture with regard to both materials and labor, and which accordingly is then susceptible of low prices of sale to the consuming public, thereby making such cigarette butt receiving packages economically available to the buying public.

Still yet another object of the present invention is to provide a new and improved cigarette butt receiving package which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
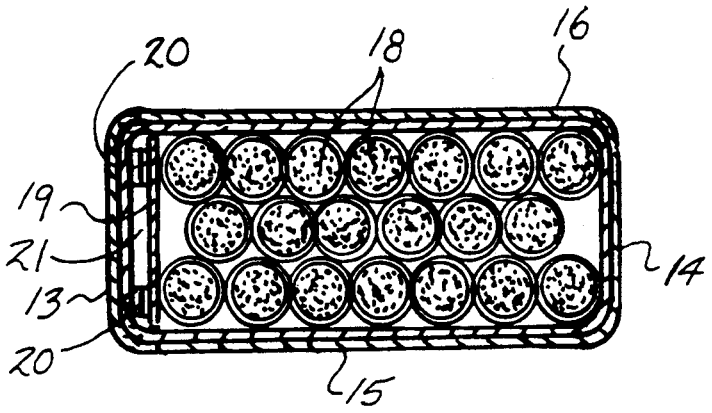
FIG. 2 is an orthographic side view, taken in elevation, of the package structure.
Figure 1:
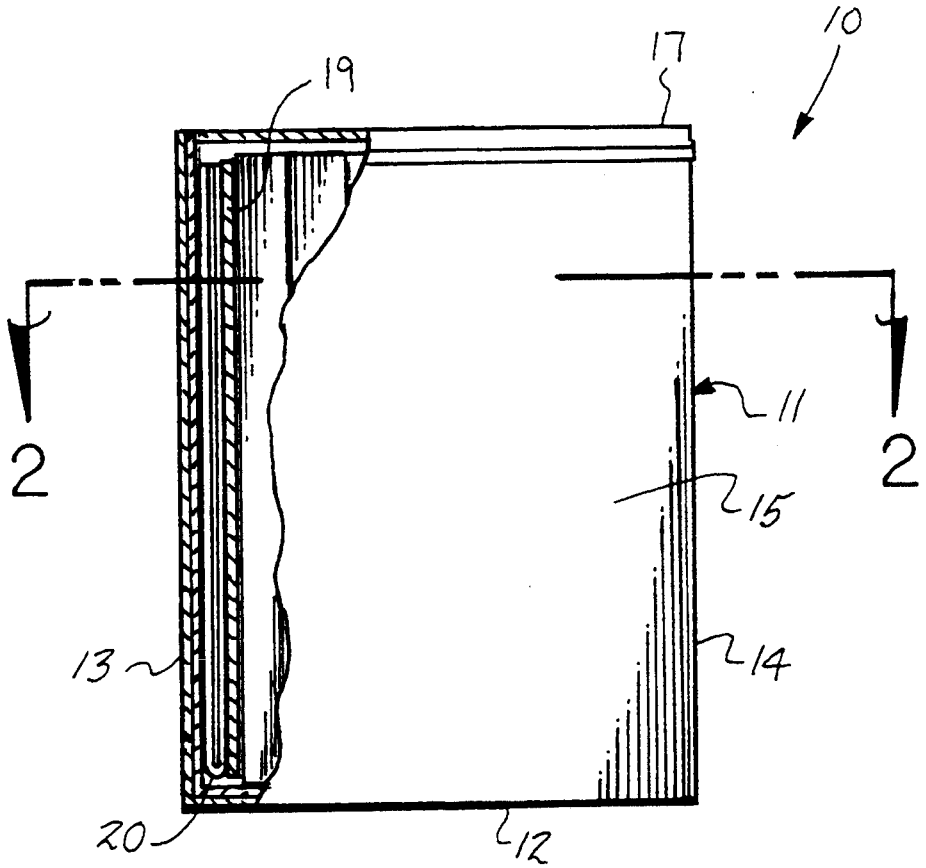
FIG. 1 is an orthographic top view of the package structure.

With reference now to the drawings, and in particular to FIGS. 1 to 8 thereof, a new and improved cigarette butt receiving package embodying the principles and concepts of the present invention and generally designated by the reference numeral 10 will be described.

More specifically, the cigarette butt receiving package 10 of the instant invention essentially comprises a container 11 having a bottom wall 12 spaced from a top wall 17, with a first end wall 13 spaced from a second end wall 14, a first side wall 15 spaced from a second side wall 16. Cigarette rods 18 are received within the container 11 divided by a push plate 19 arranged in spaced adjacency to the first end wall 13, with the push plate 19 having at least one spring member 20 indicated as a generally V-shaped configuration or other comparable configuration may be employed to effect displacement of the push plate relative to the first end wall to define a receiving space 21 to receive cigarette butts 18*a* (see FIG. 4) subsequent to the smoking of an individual cigarette rod 18. In this manner, ease of disposal of the cigarette butts within the package structure is afforded.

Figure 3:
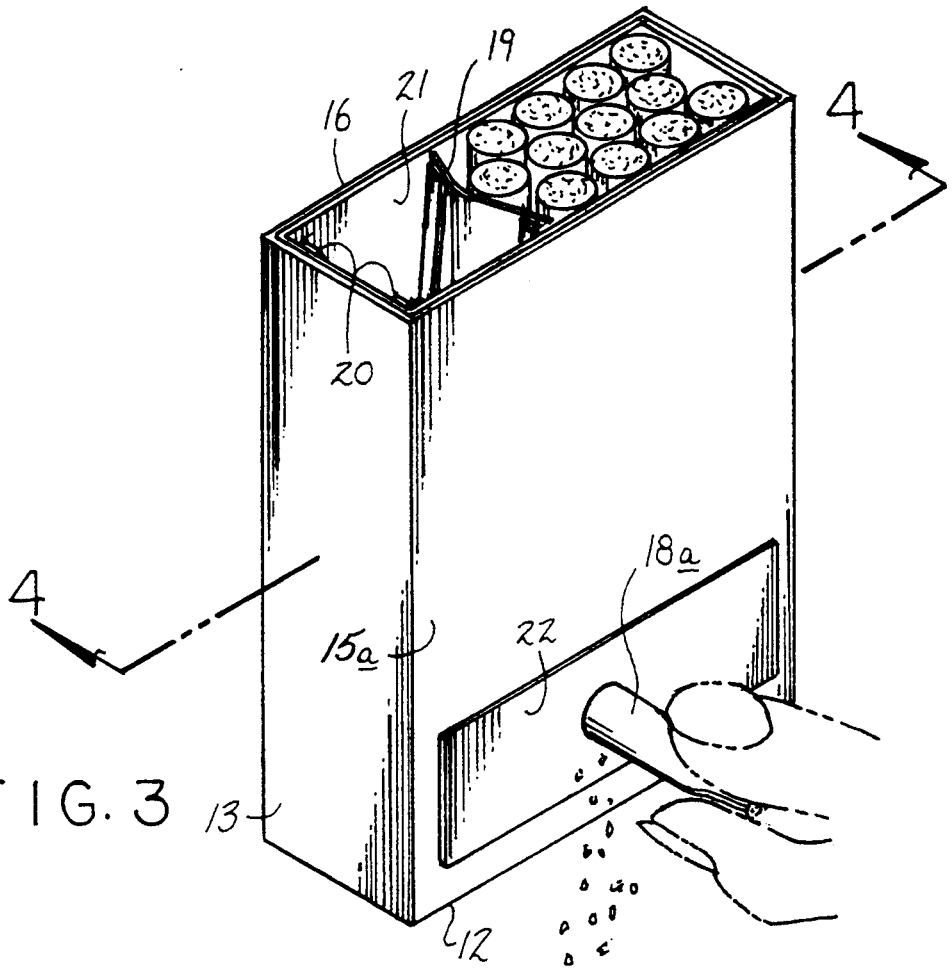
FIG. 3 is an isometric illustration of a modified front wall of the package.
Figure 4:
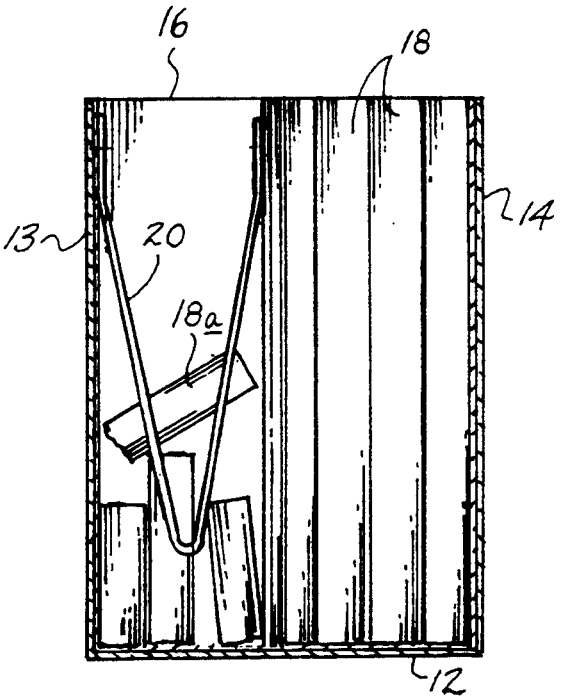
FIG. 4 is an orthographic view, taken along the lines 4—4 of FIG. 3 in the direction indicated by the arrows.
Figure 5:
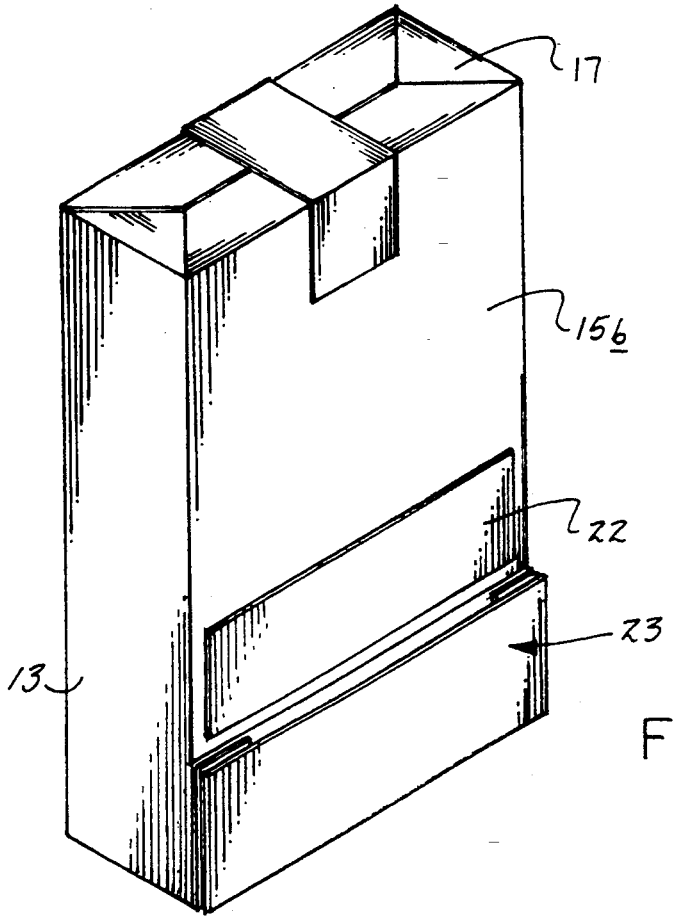
FIG. 5 is an isometric illustration of a further modified front wall of the package.
Figure 6:
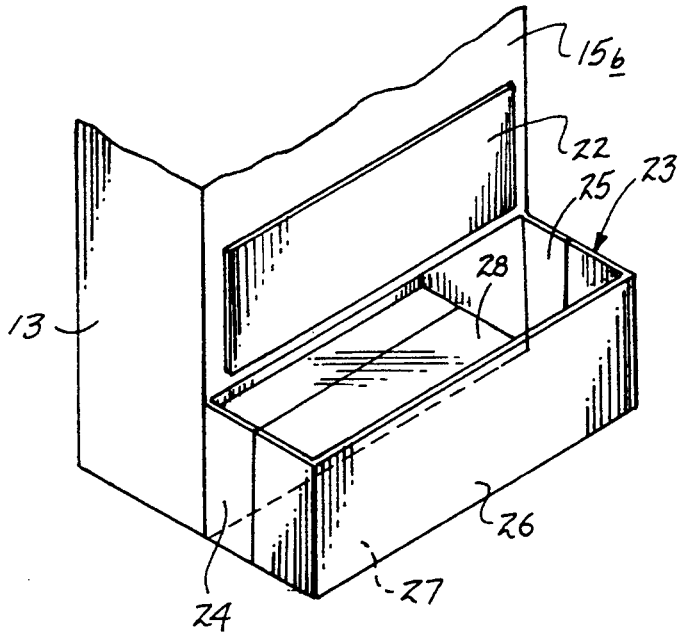
FIG. 6 is an isometric illustration indicating the front wall pocket extended relative to the front wall.

The FIG. 3 indicates the use of a metallic plate 22 mounted to a modified first side wall 15 to provide for a surface to extinguish the cigarette butts 18*a*, in a manner as indicated in FIG. 3. The FIGS. 5 and 6 indicate the use of a further modified first side wall 15*b*, having a container pocket 23 extensible therefrom, with the container pocket having first and second foldable side walls 24 and 25, as well as a pocket front wall 26 spaced from the further modified first side wall 15*b*, with a pocket floor 27 spaced below a foldable ash tray plate 28 to provide for compartmentalizing of ashes and the like to permit the use of an ash tray structure relative to the container in use when ash tray structure is unavailable otherwise.

Figure 7:
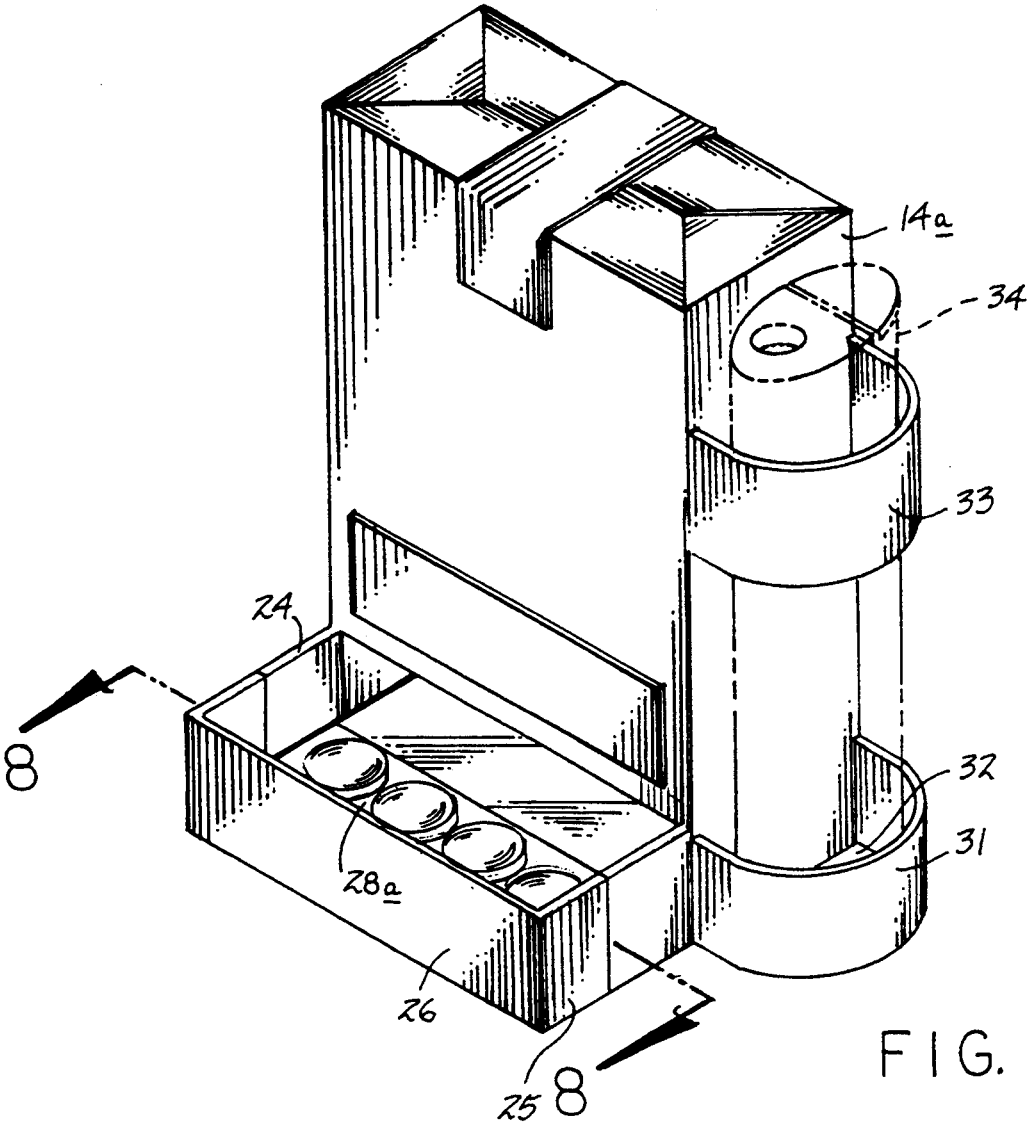
FIG. 7 is an isometric illustration of a further modified front wall structure.
Figure 8:
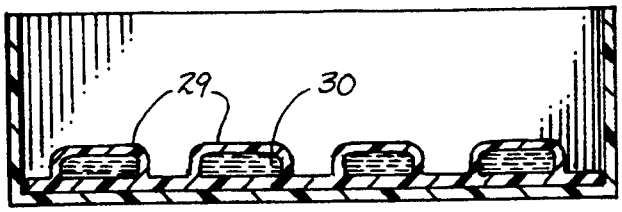
FIG. 8 is an orthographic view, taken along the lines 8—8 of FIG. 7 in the direction indicated by the arrows.

The pocket structure 23, as indicated in FIG. 7, may be further modified to include a modified foldable plate 28*a* having a plurality of capsules 29 thereon. Each of the capsules 29 is arranged to include water 30 or other convenient extinguishing fluid in the event of completely snuffing ashes and the like within the ash tray pocket 23. Further, the use of a modified second end wall 14*a*, as indicated in FIG. 7, includes an end wall pocket 31 mounted to the second end wall in adjacency to the bottom wall 12, wherein the end wall pocket includes an end wall pocket floor 32 to receive a cigarette lighter 34 thereon, with the cigarette lighter further slidably directed through an end wall loop 33 spaced from the end wall pocket floor 32.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A cigarette butt receiving package, comprising, a container having a bottom wall spaced from a top wall, a first end wall spaced from a second end wall, and a first side wall spaced from a second side wall, and the container including a push plate within the cavity extending between the bottom wall and the top wall in spaced adjacency to the first end wall, with the push plate including at least one spring member captured between the push plate and the first end wall within the container, the first side wall includes a container pocket orientated adjacent the bottom wall, the pocket having spaced first and second foldable side walls, a pocket front wall spaced from the first side wall, and a pocket floor, with a foldable plate mounted within the pocket in adjacency to the pocket floor, with the foldable plate extending from the first side wall and in spaced orientation relative to the second side wall.

2. A package as set forth in claim 1 wherein the first side wall includes a metallic plate mounted to the first side wall for extinguishing cigarettes thereon.

3. A package as set forth in claim 2 wherein the foldable plate includes a plurality of capsules thereon, each of the capsules includes an extinguishing fluid contained therewithin.

4. A package as set forth in claim 3 including an end wall pocket mounted to the second end wall in adjacency to the bottom wall, with an end wall loop mounted to the second end wall spaced from the end wall pocket, where the end wall pocket includes a pocket floor, with a cigarette lighter arranged for reception through the end wall loop and positioned upon the pocket floor.

* * * * *